US006729977B1

(12) United States Patent
Young et al.

(10) Patent No.: US 6,729,977 B1
(45) Date of Patent: May 4, 2004

(54) GOLF TEE WITH TACTILE HEIGHT ADJUSTMENT

(75) Inventors: Daniel L. Young, Escondido, CA (US); Thomas Franciscus, Escondido, CA (US); Timothy P. Curnutt, Vista, CA (US)

(73) Assignee: Fairway Products International, LLC., Escondido, CA (US)

( * ) Notice: Subject to any disclaimer, the term of this patent is extended or adjusted under 35 U.S.C. 154(b) by 0 days.

(21) Appl. No.: 10/359,814

(22) Filed: Feb. 7, 2003

(51) Int. Cl.[7] ..... A63B 57/00
(52) U.S. Cl. ..... 473/398; 473/400
(58) Field of Search ..... 473/387–403

(56) References Cited

U.S. PATENT DOCUMENTS

| | | | | | |
|---|---|---|---|---|---|
| 1,625,911 | A | * | 4/1927 | Richards | 473/398 |
| 1,638,448 | A | * | 8/1927 | Manson | 473/394 |
| 1,638,527 | A | * | 8/1927 | Clausing | 473/402 |
| 3,114,557 | A | * | 12/1963 | Cabot | 473/398 |
| 3,203,700 | A | * | 8/1965 | Antonious | 473/257 |
| 3,408,079 | A | * | 10/1968 | Kirikos | 473/398 |
| 5,759,118 | A | * | 6/1998 | Sroczynski | 473/387 |

FOREIGN PATENT DOCUMENTS

| | | | | |
|---|---|---|---|---|
| FR | 2671976 | * | 7/1992 | 273/33 |

* cited by examiner

*Primary Examiner*—Steven Wong
(74) *Attorney, Agent, or Firm*—Gary L. Eastman

(57) ABSTRACT

A golf tee with tactile height adjustment includes a cup formed to receive and retain a golf ball. From the underside of the cup, a continuously threaded shaft extends and is formed with a longitudinal flat portion. A stop is formed with a threaded bore having threads complementary to those threads formed on the threaded shaft. Extending outward from the flat portions of the shaft are tactile engagement posts formed to engage the threads of the threaded stop as it threads along the threaded shaft. The engagement posts provide for the self cleaning of the threads of the golf tee, and also provides a tactile response including a distinct resistance to rotation of the threaded stop when the stop contacts the tactile posts. More specifically, when the threaded stop is positioned on the shaft adjacent a engagement post, the rotation of the stop is more difficult than rotation at a position on the shaft having no engagement post. In this manner, the user may tactilely determine whether the positioning disc is adjacent a tactile engagement post or between tactile engagement posts.

29 Claims, 4 Drawing Sheets

GOLF TEE WITH TACTILE HEIGHT ADJUSTMENT

FIELD OF THE INVENTION

The present invention is related to golf equipment. More specifically, the present invention is particularly, though not exclusively, related to an improved golf tee having an adjustable height for placement of the golf ball for optimum contact by a golf club.

BACKGROUND OF THE INVENTION

Whether its competition between peers, or the desire to refine the game, golfing has become a popular pastime. Golfers are always in search of the perfect course, the perfect game, the perfect swing, the perfect clubs, or simply enjoying the outdoors. While the basic equipment for golfing continues to include a golf ball, golf club, and golf tee, the golfing industry has continuously made improvements to this equipment. However, despite the innovations in golfing equipment over the past years, the golf tee has remained substantially unchanged from the original wooden peg having a cup for receiving the golf ball, and improvements have been limited.

One such improvement is documented in U.S. Pat. No. 1,625,911 entitled "Golf Tee" which issued to H. L. Richards in 1926. This patent discloses a golf tee having a cup with a threaded shaft, and a positioning disc formed with a threaded bore sized to receive the threaded shaft. By rotating the positioning disc relative to the threaded shaft, the positioning disc may be advanced over the shaft thereby raising the effective height of the golf tee. More particularly, by rotating the positioning disc clockwise relative to the shaft, the positioning disc advances toward the head of the tee making the effective height of the tee smaller. On the other hand, by rotating the positioning disc counter-clockwise relative to the shaft, the positioning disc advances away from the head of the tee making the effective height of the tee greater.

The golf tee disclosed by Richards was a stark improvement over the wooden peg, and provided the golfer with the ability to adjust the height of the golf tee. However, because the threaded portion of the golf tee is inserted into the playing surface, or soil, the ability to adjust the height of the golf tee ceases after the first use because the threads are filled with soil. Thus, while the Richards' tee is adjustable, it is not re-adjustable due to the accumulation of soil in the threads.

Another improvement to golf tees is shown in U.S. Des. Pat. No. Des. 370,041 entitled "Adjustable Height Golf Tee", which issued to C. A. Thomas in 1996. This patent discloses a golf tee formed with a series of partially circumferential notches formed along the golf tee shaft, and a positioning disc formed with a center bore having an internal tab insertable into the circumferential notches. By choosing which of the circumferential notches to place the tab, the effective height of the golf tee is determined. For instance, when the desired height of the golf tee is small, the positioning disc is positioned along the shaft and the internal tab is inserted into a notch closer to the head of the tee. On the other hand, when the desired height of the golf tee is large, the positioning disc is positioned over the shaft and the internal tab is inserted into a notch closer to the base of the tee.

Because there are only a limited number of notches formed in distinct locations along the shaft of the golf tee, the height of the Thomas tee is only adjustable to a limited number of positions. Also, as with the Richards tee, once the Thomas tee is inserted into the soil, the partial circumferential notches of the Thomas tee will fill with soil thereby decreasing the ability to re-adjust the height of the tee.

U.S. Pat. No. 5,672,122 entitled "Adjustable Golf Tee" which issued to P. G. Strong in 1997 discloses a golf tee having a shaft formed with a series of circumferential grooves, and a disc-like member formed with an offset internal aperture sized to receive the shaft, and formed with a smaller, central aperture which contacts the selected circumferential groove securing the disc-like member in place along the shaft. The disc-like member acts as a vertical stop to adjust the effective height of the golf tee.

Even though a number of circumferential grooves are formed along the shaft, the placement of the disc-like member is still limited to a handful of distinct positions. The disc-like member must be engaged into one of the circumferential grooves in order to set the height of the tee, and thus the golf tee is not continually adjustable along its entire length. Further, as with the other golf tees described above, the circumferential grooves will fill with soil on the first use, thereby complicating a second use of the tee with an different height.

U.S. Des. Pat. No. 413,640 entitled "Continuously Variable Height Golf Tee" which issued to W. P. Feurer III in 1999 discloses a golf tee having a threaded shaft, and a positioning disc formed with a threaded bore sized to receive the threaded shaft. The positioning disc is sized to have a diameter significantly larger than the diameter of the tee head for receiving the golf ball. Like the device disclosed in the '911 patent, by rotating the positioning disc relative to the threaded shaft, the positioning disc may be advanced along the shaft thereby raising the effective height of the golf tee. More particularly, by rotating the positioning disc clockwise relative to the shaft, the positioning disc advances toward the head of the tee making the effective height of the tee smaller. On the other hand, by rotating the positioning disc counter-clockwise relative to the shaft, the positioning disc advances away from the head of the tee making the effective height of the tee greater.

The Feurer patent discloses a device, which is very similar to the Richards device outlined above, including the threaded shaft and a positioning disc formed with a threaded bore. As with the Richards device, the threads of the Feurer device will become filled with soil once inserted into the playing surface, effectively fixing the height of the tee for future use.

Another deficiency in the Feurer golf tee is the inability to consistently position the tee at a particular height. For instance, a particular height may be determined to be optimum for a particular golf club being used. However, once the golf tee has been used, it is often damaged, thereby preventing its re-use. However, because the Feurer golf tee has no indicia for identifying height settings, it is virtually impossible to set the height of the new tee to the height of the damaged tee unless a precise measurement was taken. Such measurements are unlikely to be taken during the heated competition of a golf game, and thus, there will inevitably exist a difference in the effective height of the golf tee.

Another concern with current golf tees is the inability to adjust the device without looking at it closely. For example, in order to precisely set the device disclosed in the '122 and '041 patents, the golfer must closely examine the tee and position the disk in the proper groove or slot. Similarly, the devices disclosed in the '640 and '911 patents would require the golfer to take a measurement of the effective height of the golf tee, or count threads—neither of which is likely during a golf game. Coupling the requirement for a close visual examination of the golf tee with a golfer having far-sightedness, renders the current adjustable golf tees little improvement over the wooden peg golf tee.

While there have been a number of "adjustable" golf tees introduced to the marketplace, none truly remain adjustable following its first use. Also, while many golf tees have been touted as an adjustable tee, many are not continuously adjustable along the length of the shaft of the tee, and instead provide only a handful of fixed-height options.

In light of the above, it would be advantageous to provide a golf tee that is continuously adjustable along the entire length of the shaft. It would also be advantageous to provide a golf tee that is initially adjustable, and remains easily adjustable following removal from the soil of the playing surface. It is also advantageous to provide a golf tee having the ability to consistently set the height of the tee, regardless of use or re-use, and without the requirement for close visual examination by the golfer.

SUMMARY OF THE INVENTION

The golf tee of the present invention includes a cup formed to receive and retain a golf ball. From the underside of the cup, a continuously threaded shaft extends and is formed with a longitudinal flat portion. A stop is formed with a threaded bore having threads complementary to those threads formed on the threaded shaft. Extending outward from the flat portions of the shaft are tactile engagement posts formed to engage the threads of the threaded stop as it threads along the threaded shaft.

The engagement posts provide for the self-cleaning of the threads of the golf tee, and also provides a tactile response. There is a distinct resistance to rotation of the threaded stop when the stop contacts the tactile posts. More specifically, when the threaded stop is positioned on the shaft adjacent a engagement post, the rotation of the stop is more difficult than rotation at a position on the shaft having no engagement post. In this manner, the user may tactilely determine whether the positioning disc is adjacent a tactile engagement post or between tactile engagement posts.

By introducing the positioning disc to the end of the shaft opposite the cup, the golfer may begin rotating the positioning disc about the shaft thereby advancing the positioning disc toward the cup. Due to the tactile feedback provided by the tactile engagement post, the golfer may determine the exact position of the threaded stop along the shaft simply by counting the number of tactile posts that have been passed. As a result of this purely tactile height setting, a golfer having little or no near-sightedness can easily, accurately, and repeatably set the height of his or her golf tee.

DETAILED DESCRIPTION OF A PREFERRED EMBODIMENT

Figure 1:
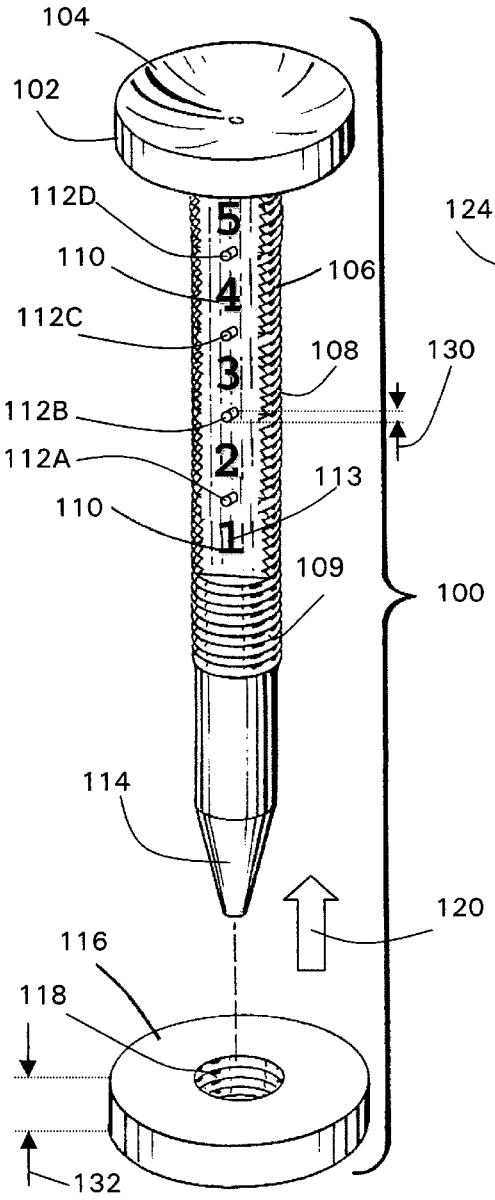
FIG. 1 is an exploded perspective view of the golf tee with tactile height adjustment of the present invention showing a golf tee having a head formed with a ball-receiving cup, and a threaded shaft extending downward from the head and formed with a flat portion having a series of engagement posts to provide tactile resistance to a threaded stop as the threaded stop is advanced along the threaded shaft.

Referring initially to FIG. 1, an exploded perspective view of the golf tee with tactile height adjustment of the present invention is generally designated 100. Golf tee 100 includes a head 102 formed with a ball-receiving cup 104, and a shaft 106 extending downward from the head and formed with threads 108. Shaft 106 is also formed with a flat portion 110 having a series of engagement posts 112A, 112B, 112C and 112D. Shaft 106 of golf tee 100 ends in a tapered point 114 to facilitate the placement of shaft 106 into the playing surface, namely, grass-covered soil.

The golf tee with tactile height adjustment 100 of the present invention also includes a stop 116 formed with a threaded bore 118 sized to receive threaded shaft 106. When the stop 116 is advanced in direction 120, and rotated in direction 122 (shown in FIG. 2), the stop 116 advances along threaded shaft 106.

As shown in FIG. 1, a plurality of indicia 11 3 are formed or printed on shaft 106 to provide a visual marker for the positioning of the threaded stop 116 along the threaded shaft 106. In a preferred embodiment, indicia 113 may include numbers, such as the numbers 1, 2, 3, 4, and 5 as shown, or other indicia may be used.

Figure 2:
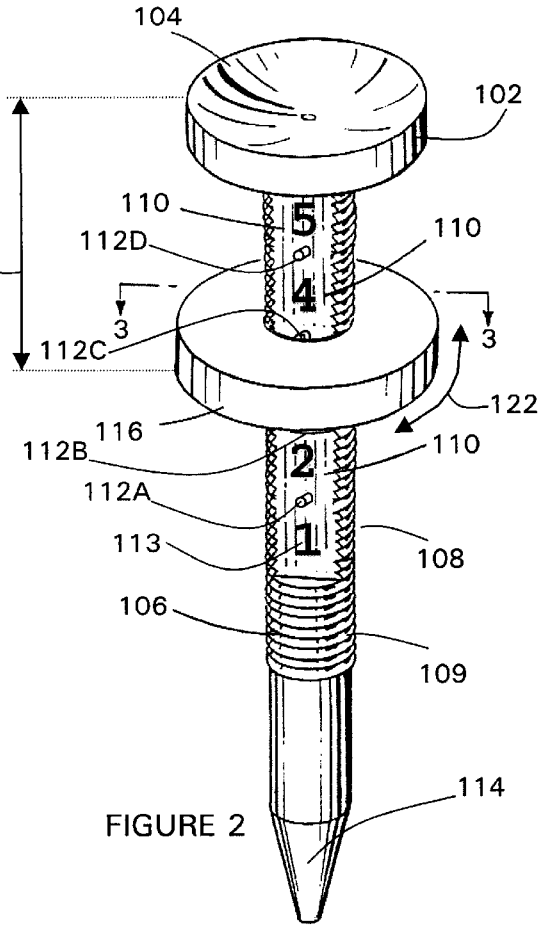
FIG. 2 is a perspective view of the golf tee with tactile height adjustment of the present invention showing the golf tee having a head formed with a ball-receiving cup, and a threaded shaft extending downward from the head and with the threaded stop positioned midway along the threaded shaft to define a tee height that may be varied by rotating threaded stop about the threaded shaft.

Referring now to FIG. 2, a perspective view of the golf tee with tactile height adjustment of the present invention 100 is presented showing stop 116 threadably engaged on shaft 106. As shown in this Figure, stop 116 has been positioned such that threaded bore 118 receives shaft 106 and is rotated in direction 122 to advance the stop 116 in direction 120 toward head 102.

Figure 3:
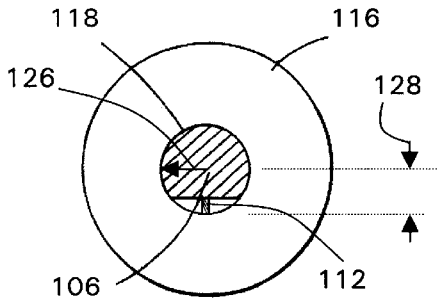
FIG. 3 is a cross-sectional view of the golf tee with tactile height adjustment of the present invention as taken along line 3—3 of FIG. 2, and showing the threaded shaft encircled by the threaded stop, with the engagement post extending radially from the threaded shaft and perpendicularly from the flat portion of the threaded shaft to engage the threads of the threaded stop thereby providing tactile resistance to a threaded stop as the threaded stop is advanced along the threaded shaft.

FIG. 3 is a cross-sectional view of the golf tee with tactile height adjustment of the present invention 100 as taken along line 3—3 of FIG. 2, and showing the threaded shaft 106 encircled by the threaded stop 116, with the engagement post 112 extending perpendicularly from the flat portion 110 of the threaded shaft 106 to engage the threads 118 of the threaded stop 116 thereby providing tactile resistance to a threaded stop 116 as the threaded stop 116 is rotated along the threaded shaft 106 in direction 122.

Continuously Variable Tee Height

The position of stop 116 on shaft 106 defines a tee height 122 as shown in FIG. 2. Tee height 122 is the distance between the lower surface of stop 116, and the upper surface, or cup 104, of head 102. It is to be appreciated that any tee height 124 may be established by rotating stop 116 in direction 122 thereby advancing the stop 116 toward head 102 to shorten the tee height 124, or away from head 102 to lengthen the tee height 124. Because there are no set positions for stop 116, a tee height 124 may be established along the entire length of the shaft 106 ranging from a very short tee when the stop 116 is adjacent head 102, to a very tall tee when the stop 116 is on threaded portion 109 adjacent pointed end 114.

Tactile Feedback Corresponding to Tee Height

As stop 116 is positioned over tapered point 114, threaded bore 118 engages threads 108 of shaft 106. As stop is rotated in direction 122, such as clockwise for a standard threaded shaft 106, stop 116 advances along shaft 106 in direction 120. As stop 116 passes from the lower threaded portion 109 to the portion of shaft 106 having flat portions 110, the surface area of contact between the threaded shaft 106 and the threaded bore 118 decreases by approximately twenty five percent (25%). FIG. 3 clearly shows this decreased surface area of contact. The decrease in surface area of contact corresponds to a decrease in the rotational friction experienced by the golfer as he or she is rotating the stop 116 along shaft 106. As a result, the golfer may determine tactically where along the shaft 106 the stop 116 is positioned.

As the stop 116 continues to be rotated in direction 122, stop advances in direction 120 toward head 102. When stop 116 passes over engagement post 112, the surface area of contact increases due to the contact of the engagement post 112 to threads 118. More specifically, engagement post 112 has a length such that engagement post height 128 is the same as threaded shaft radius 126 resulting in the engagement post physically contacting threads 118 of stop 116. This increased friction provides the golfer with tactile feedback acknowledging positioning of the stop 116 over the first engagement post 112A.

By continuing the rotation of stop 116 in direction 120 and 122 toward head 102, stop 116 passes over engagement post 112B, and may be continued all the way to head 102, with tactile feedback providing information to the golfer as to the particular tee height 124. Using this method for establishing tee height 124, the golfer may set or adjust the tee height 124 without visually confirming the proper setting. This feature is particularly useful when the golfer cannot see the golf tee well, such as golfers suffering from far-sightedness.

While FIGS. 1 through 3 depict a golf tee formed with four engagement posts 112A, 112B, 112C, and 112D, it is to be appreciated that shaft 106 may be formed with any number of engagement posts. For instance, ten (10) engagement tabs 112 may be formed along shaft 106 to provide tactile feedback to the golfer for ten distinct tee heights 124.

Engagement posts 112 have been shown with a diameter 130, and stop 116 has been shown with a height 132. In a preferred embodiment, diameter 130 may be less than height 132 in order to optimize the self-cleaning aspects of the present invention. Alternatively, diameter 130 may be equal to or larger than height 132.

Self Cleaning Reusable Golf Tee

One of the primary challenges to using currently available adjustable golf tees is the fact that they are not practically reusable because soil becomes trapped in the other tees. The golf tee with tactile height adjustment of the present invention 100 is self-cleaning. The self-cleaning nature of the present invention is achieved by two primary features, alone or in combination.

The first feature providing for the self cleaning of the golf tee with tactile height adjustment of the present invention 100 is the flat portion 110. As stop 116 is rotated in direction 122, any soil that is trapped in threads 108 becomes un-trapped when passing over flat portion 110. As a result, any soil that would damage other golf tees will be easily removed from the golf tee with tactile height adjustment of the present invention 100 as the soil passes over the flat portion 110.

The second feature providing for the self cleaning of the golf tee with tactile height adjustment of the present invention 100 is the engagement post 112 passing through threads 118 of stop 116 as it rotates past the engagement post 112 during the adjustment of the tee height 124. More specifically, as the engagement post 112 passes through threads 118, any soil remaining in threads 118 are removed.

As a result of the self cleaning nature of the golf tee with tactile height adjustment of the present invention 100, the tee may be set for a particular tee height 124, inserted into the playing surface (soil) for use, and then removed and the tee height 124 may be adjusted for the next use without excessive friction, or resistance due to soil-fouled threads.

An Alternative Embodiment of the Present Invention

Figure 4:
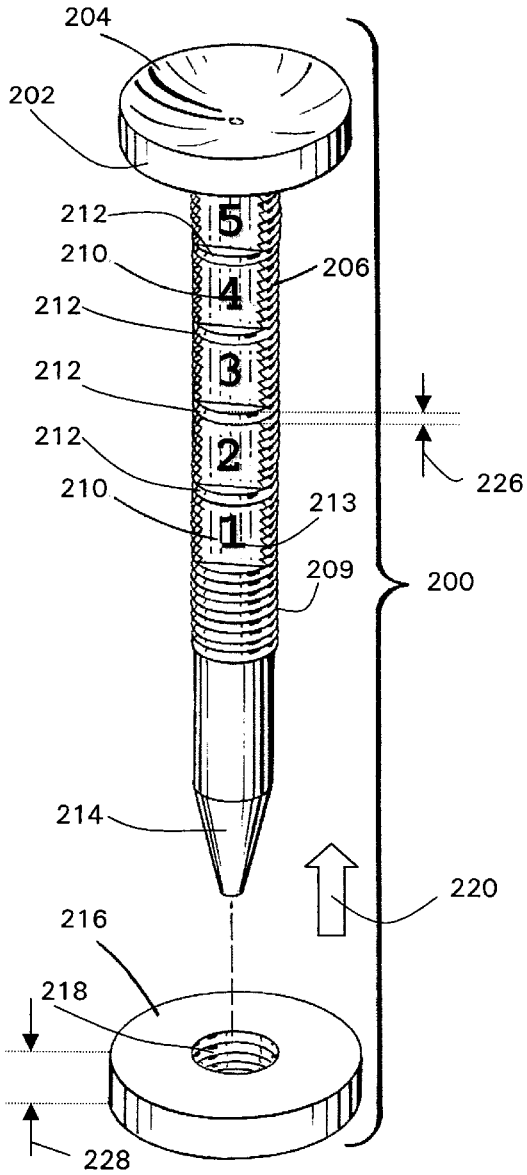
FIG. 4 is an exploded perspective view of an alternative embodiment of the golf tee with tactile height adjustment of the present invention showing a golf tee having a head formed with a ball-receiving cup, and a threaded shaft extending downward from the head and formed with a flat portion having a series of engagement tabs to provide tactile resistance to a threaded stop as the threaded stop is advanced along the threaded shaft.

Referring now to FIG. 4 an exploded perspective view of an alternative embodiment of the golf tee with tactile height adjustment of the present invention is shown and generally designated 200. Golf tee 200 includes a head formed 202 with a ball-receiving cup 204, and a shaft 206 formed with threads 208 and extending downward from the head 102 and formed with a flat portion 210 having a series of engagement tabs 212A, 212B, 212C, and 212D.

The golf tee with tactile height adjustment 200 of the present invention also includes a stop 216 formed with a threaded bore 218 sized to receive threaded shaft 206. When the stop 216 is advanced in direction 220, and rotated in direction 222 (shown in FIG. 5), the stop 216 advances along threaded shaft 206.

Figure 5:
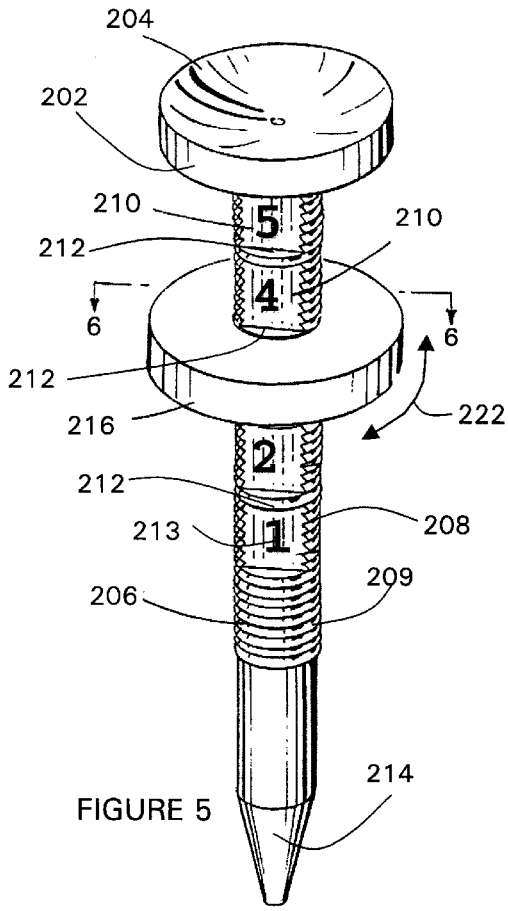
FIG. 5 is a perspective view of the golf tee with tactile height adjustment of the present invention showing the golf tee having a head formed with a ball-receiving cup, and a threaded shaft extending downward from the head and with the threaded stop positioned midway along the threaded shaft to define a tee height that may be varied by rotating threaded stop about the threaded shaft.

Referring now to FIG. 5, a perspective view of the golf tee with tactile height adjustment of the present invention 200 is presented showing stop 216 threadably engaged on shaft 206. As shown in this Figure, stop 216 has been positioned such that threaded bore 218 receives shaft 206 and is rotated in direction 222 to advance the stop 216 in direction 220 toward head 202.

In a preferred embodiment, each engagement tab 212 has a thickness 226, and the stop 216 has a height 228. In order to facilitate the removal of dirt from golf tee 200, thickness 226 may be less than height 228. Alternatively, thickness 226 may be equal to or greater than height 228.

Figure 6:
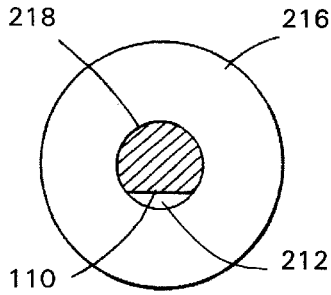
FIG. 6 is a cross-sectional view of the golf tee with tactile height adjustment of the present invention as taken along line 3—3 of FIG. 2, and showing the threaded shaft encircled by the threaded stop, with the engagement tab extending perpendicularly from the flat portion of the threaded shaft and perpendicular to the length of the threaded shaft to engage the threads of the threaded stop thereby providing tactile resistance to a threaded stop as the threaded stop is advanced along the threaded shaft.

FIG. 6 is a cross-sectional view of the golf tee with tactile height adjustment of the present invention 200 as taken along line 6—6 of FIG. 5, and showing the threaded shaft 206 encircled by the threaded stop 216, with the engagement tab 212 extending perpendicularly from the flat portion 210 of the threaded shaft 206 to engage the threads 218 of the threaded stop 216 thereby providing tactile resistance to a threaded stop 216 as the threaded stop 216 is rotated along the threaded shaft 206 in direction 222.

As with the golf tee with tactile height adjustment of the present invention 100, alternative embodiment 200 also provides the same continuously variable tee height, and tactile feedback corresponding to tee height, and also provides for the self-cleaning of the golf tee 200 during use.

Figure 7:
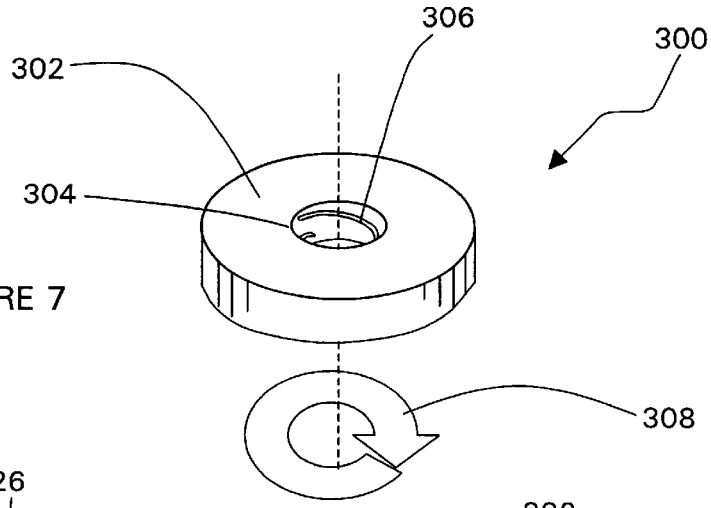
FIG. 7 is a perspective view of an alternative embodiment of the threaded stop having a single, 360 degree thread which provides a stop which is self-cleaning and resistant to fouling by the accumulation of soil on the threaded portion of the threaded shaft.

Referring now to FIG. 7, a perspective view of an alternative embodiment of the threaded stop is shown and generally designated 300. Threaded stop 300 includes a body 302 formed with a bore 304 having a single, 360 degree thread 306 which provides a stop which is self-cleaning and resistant to fouling by the accumulation of soil on the threaded portion of the threaded shaft (not shown this Figure). In use, the rotation of stop 300 in direction 308 advances the threaded stop 300 along the threaded shaft. Because thread 306 has only one revolution (360 degrees), soil that has accumulated on the threaded shaft is easily removed as the threaded stop 300 is advanced. The single thread 306, coupled with the flat portion 110 having a series of engagement posts 112A, 112B, 112C and 112D as discussed in conjunction with FIG. 1, provide an a golf tee having superior functionality and reuse.

Figure 8:
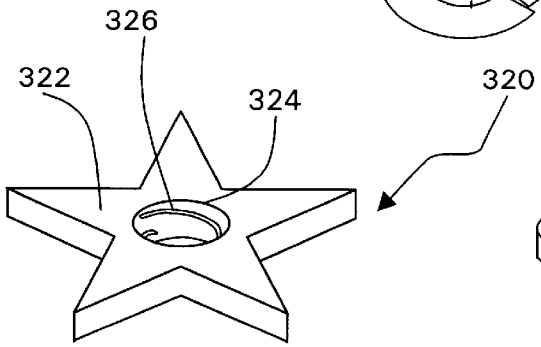
FIG. 8 is a perspective view of an alternative embodiment of the threaded stop having a star shape and having a single, 360 degree thread.

Referring now to FIG. 8, a perspective view of an alternative embodiment of the threaded stop is generally designated 320. Threaded stop 320 is formed with a body 322 having a star shape and formed with a bore 324 having a single, 360-degree thread 326.

Figure 9:
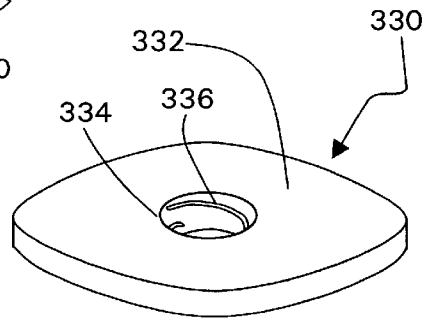
FIG. 9 is a perspective view of another alternative embodiment of the threaded stop having a oblong shape and having a single, 360 degree thread.

FIG. 9 is a perspective view of another alternative embodiment of the threaded stop and is generally designated 330. Threaded stop 330 includes a body 332 having an oblong shape and formed with a bore 334 having a single, 360-degree thread 336.

Figure 10:
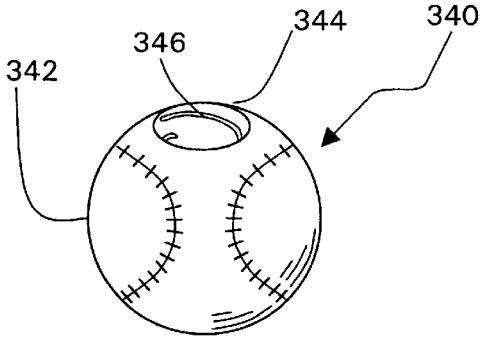
FIG. 10 is a perspective view of yet another alternative embodiment of the threaded stop having a three-dimensional shape depicting a baseball, and having a single, 360 degree thread.

FIG. 10 is a perspective view of yet another alternative embodiment of the threaded stop of the present invention and is generally designated 240. Threaded stop 340 includes a three-dimensional body 342 shaped to depict a baseball, and formed with an axial bore 344 having a single, 360 degree thread 346.

Figure 11:
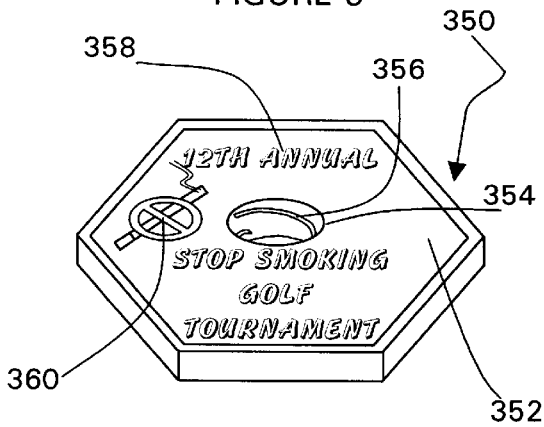
FIG. 11 is a perspective view of yet another alternative embodiment of the threaded stop having a hexagonal shape and embossed or imprinted indicia, such as artwork consisting of drawings and/or text, and also having a single, 360 degree thread.

FIG. 11 is a perspective view of yet another alternative embodiment of the threaded stop of the present invention and is generally designated 350. Threaded stop 350 includes a body 252 having a hexagonal shape and formed with a bore 354 formed with a single, 360 degree thread 356. Body 352 may be embossed or imprinted with indicia, such as text 358 and/or artwork 360 to provide a novelty item having a particular focus, such as advertisement or promotional purpose, of featuring a proprietary logo.

It is to be appreciated, however, that while threaded stops shown in FIGS. 7–11 have been formed with a single, 360 degree thread, continuous threads are contemplated, and may be substituted in threaded stops 300, 320, 330, 340 and 350 without departing from the present invention. It is also to be appreciated that while a threaded stops depicted herein include a variety of shapes, such presented shapes are not intended to be limiting, rather, merely exemplary of preferred embodiment. Other shapes are fully contemplated herein and are considered within the scope of the present invention.

Figure 12:
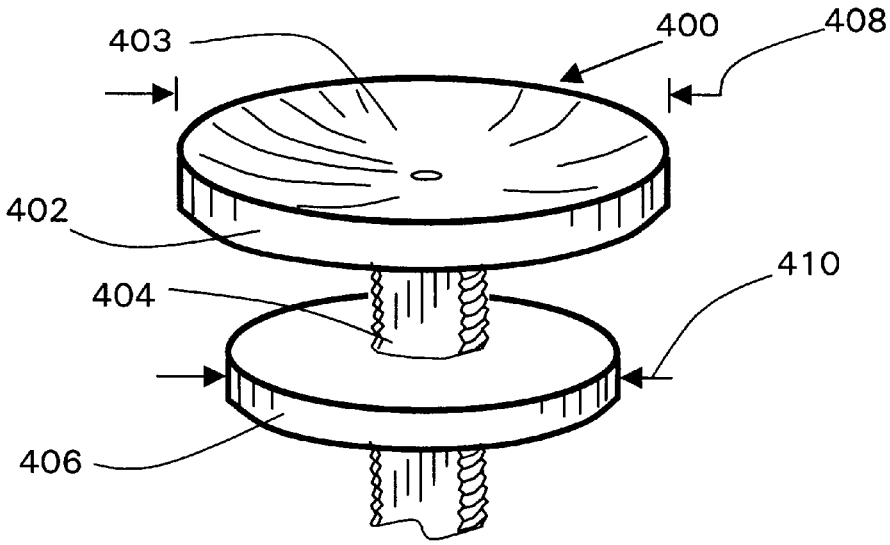
FIG. 12 is a perspective view of another alternative embodiment of the golf tee with tactile height adjustment of the present invention showing a golf tee having an enlarged head formed with a ball-receiving cup, and a threaded shaft extending downward through a threaded stop having a smaller diameter than the head.

Referring now to FIG. 12, a perspective view of another alternative embodiment of the golf tee with tactile height adjustment of the present invention is shown and generally designated 400. Golf tee 400 includes an enlarged head 402 formed with a ball-receiving cup 403, and a threaded shaft 404 extending downward through a threaded stop 406. Enlarged head 402 is formed with a first diameter 408, and threaded stop 406 is formed with a smaller diameter 410.

From FIG. 12, it is to be appreciated that the diameter 410 of the threaded stop 406 may be different than diameter 408 of head 402. More specifically, although various size relationships between the threaded stop 406 and the head 402 of the golf tee 400 have been depicted in the Figures, it is to be understand that any relationship is fully contemplated herein, and that no limitations as to the relative sizes are intended.

Figure 13:
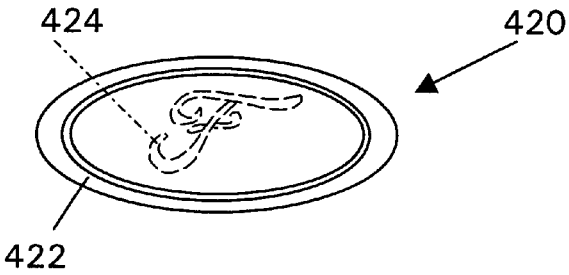
FIG. 13 is a top view of an alternative embodiment of the golf tee with tactile height adjustment of the present invention and having a head with a non-round shape resembling a well-known trademark logo.

FIG. 13 is a top view of an alternative embodiment of the golf tee with tactile height adjustment of the present invention and generally designated 420. Golf tee 420 includes a head 422 having a non-round shape resembling a well-known trademark logo, and imprinted or embossed with artwork 424.

Figure 14:
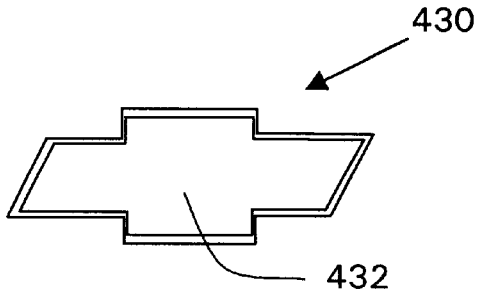
FIG. 14 is a top view of another alternative embodiment of the golf tee with tactile height adjustment of the present invention and having a head with a non-round shape resembling a well-known trademark logo.

FIG. 14 is a top view of another alternative embodiment of the golf tee with tactile height adjustment of the present invention and is generally designated 430. Golf tee 430 is formed with a head 432 having a non-round shape resembling a well-known trademark logo.

Figure 15:
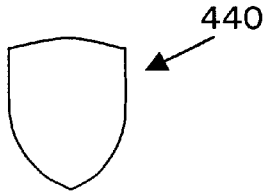
FIG. 15 is a top view of yet another alternative embodiment of the golf tee with tactile height adjustment of the present invention and having a head with a non-round shape resembling a well-known trademark logo.

FIG. 15 is a top view of yet another alternative embodiment of the golf tee with tactile height adjustment of the present invention, generally designated 440, and having a head with a non-round shape resembling a well-known trademark logo.

Figure 16:
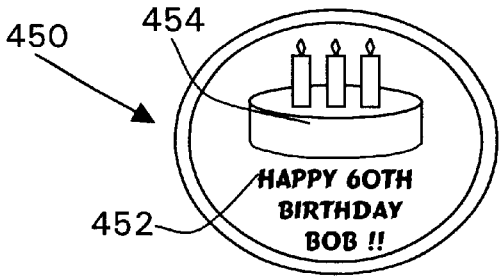
FIG. 16 is a top view of an alternative embodiment of the golf tee with tactile height adjustment of the present invention having an enlarged surface area and formed and imprinted with a message or artwork.

FIG. 16 is a top view of an alternative embodiment of the golf tee with tactile height adjustment of the present invention and generally designated 450. Golf tee 450 is formed with an enlarged surface area and formed and imprinted with a message 452 or artwork 454.

While the golf tee with tactile height adjustment of the present invention as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A golf tee, comprising:

a threaded shaft having a first end and a second end, and formed with a flat portion extending longitudinally along said shaft between said first end and said second end;

a head attached to said first end and formed with a ball-receiving cup; a stop formed with a threaded bore, said bore sized to receive said threaded shaft and threadable thereon; and a plurality of engagement posts extending from said flat portion to engage said threaded bore as said stop is adjacent said engagement post.

2. The golf tee of claim 1, wherein said plurality of engagement posts extend radially from said threaded shaft.

3. The golf tee of claim 2, wherein said threaded shaft has a radius, and said engagement posts have a height equal to said radius.

4. The golf tee of claim 1, wherein said plurality of engagement posts extend perpendicularly from said flat portion.

5. The golf tee of claim 1, wherein said second end of said shaft is formed with a point.

6. The golf tee of claim 1, wherein said engagement post has a diameter and said stop has a height greater than said diameter.

7. The golf tee of claim 1, wherein said engagement post has a diameter and said stop has a height less than said diameter.

8. The golf tee of claim 1, wherein said engagement post has a diameter and said stop has a height equal to said diameter.

9. The golf tee of claim 1, wherein said stop rotates about said shaft with a first friction and rotates about said shaft with a second friction adjacent said engagement post to provide tactile feedback.

10. The golf tee of claim 1, wherein said head is formed with a circular shape.

11. The golf tee of claim 1, wherein said head is formed with a non-circular shape.

12. A golf tee, comprising:

a head formed with a ball-receiving cup;

a shaft formed with threads and extending downward from said head and formed with a flat portion having a plurality of engagement tabs; and a stop formed with a threaded bore sized to receive said threaded shaft and threadable thereon.

13. The golf tee of claim 12, wherein said shaft has a radius, and said engagement tabs have a height equal to said radius.

14. The golf tee of claim 12 wherein said engagement tabs have a thickness and said stop has a height greater than said thickness.

15. The golf tee of claim 12 wherein said engagement tabs have a thickness and said stop has a height less than said thickness.

16. The golf tee of claim 12 wherein said engagement tabs have a thickness and said stop has a height equal to said thickness.

17. The golf tee of claim 12, wherein said second end is formed with a tapered point.

18. The golf tee of claim 12, wherein said stop rotates about said shaft with a first friction and rotates about said shaft with a second friction adjacent said engagement tab to provide tactile feedback.

19. A golf tee, comprising:

a threaded shaft having a first end and a second end;

a head attached to said first end and formed with a ball-receiving cup;

a stop formed with a threaded bore, said bore sized to receive said threaded shaft and threadable thereon; and a means for providing tactile feedback corresponding to the position of said stop on said shaft.

20. The golf tee of claim 19, wherein said means for providing tactile feedback corresponding to the position of said stop on said shaft further comprises said shaft formed with a flat portion extending longitudinally along said shaft between said first end and said second end, and a plurality of engagement posts extending from said flat portion to engage said threaded bore as said stop is adjacent said engagement post.

21. The golf tee of claim 20, wherein said shaft has a radius and said engagement posts have a height equal to said radius.

22. The golf tee of claim 19, wherein said means for providing tactile feedback corresponding to the position of said stop on said shaft further comprises said shaft formed with a flat portion extending longitudinally along said shaft between said first end and said second end and having a plurality of engagement tabs extending from said flat portion to engage said threaded bore as said stop is adjacent said engagement tab.

23. The golf tee of claim 19, wherein said threaded bore in said threaded stop is formed with a single thread.

24. The golf tee of claim of claim 23 wherein said single thread is a 360-degree thread.

25. A golf tee, comprising:

a threaded shaft having a first end and a second end;

a head attached to said first end and formed with a ball-receiving cup;

a stop formed with a bore, said bore sized to receive said threaded shaft and formed with a single, 360 degree thread corresponding to said threaded shaft; and a means for providing tactile feedback corresponding to the position of said stop on said shaft.

26. The golf tee of claim 25, wherein said means for providing tactile feedback corresponding to the position of said stop on said shaft further comprises said shaft formed with a flat portion extending longitudinally along said shaft between said first end and said second end, and a plurality of engagement posts extending from said flat portion to engage said threaded bore as said stop is adjacent said engagement post.

27. The golf tee of claim 26, wherein said shaft has a radius and said engagement posts have a height equal to said radius.

28. The golf tee of claim 26, wherein said flat portion includes indicia.

29. The golf tee of claim 25, wherein said head is formed with a non-circular shape.

* * * * *